US009327332B2

(12) United States Patent
Flehmig et al.

(10) Patent No.: US 9,327,332 B2
(45) Date of Patent: May 3, 2016

(54) METHOD FOR CONTROLLING THE FLOW OF MATERIAL WHEN DEEP-DRAWING A WORKPIECE, AND DEEP-DRAWING DEVICE

(75) Inventors: Thomas Flehmig, Ratingen (DE); Klaus Göhler, Duisburg (DE); Konstantinos Savvas, Oberhausen (DE)

(73) Assignee: ThyssenKrupp Steel Europe AG, Duisburg (DE)

( * ) Notice: Subject to any disclaimer, the term of this patent is extended or adjusted under 35 U.S.C. 154(b) by 611 days.

(21) Appl. No.: 12/936,727

(22) PCT Filed: Mar. 31, 2009

(86) PCT No.: PCT/EP2009/053835

§ 371 (c)(1),
(2), (4) Date: Dec. 28, 2010

(87) PCT Pub. No.: WO2009/124860

PCT Pub. Date: Oct. 15, 2009

(65) Prior Publication Data

US 2011/0094283 A1 Apr. 28, 2011

(30) Foreign Application Priority Data

Apr. 7, 2008 (DE) ..... 10 2008 017 728

(51) Int. Cl.
*B21D 22/22* (2006.01)
*B21D 24/04* (2006.01)
*B21D 25/00* (2006.01)

(52) U.S. Cl.
CPC ..... *B21D 22/22* (2013.01); *B21D 24/04* (2013.01); *B21D 25/00* (2013.01)

(58) Field of Classification Search
CPC ..... B21D 22/20; B21D 22/206; B21D 22/22; B21D 24/04; B21D 22/14; B21D 31/005; B21D 25/00
USPC ..... 72/347–351, 308, 309, 313, 316, 384, 72/403, 413, 469, 417
See application file for complete search history.

(56) References Cited

U.S. PATENT DOCUMENTS 4,615,205 A 10/1986 Ragland, Jr.
4,890,471 A * 1/1990 Ito ..... 72/348

(Continued)

FOREIGN PATENT DOCUMENTS

DE 2828431 12/1979
DE 102 09 475 10/2003

(Continued)

OTHER PUBLICATIONS

English language translation of Japanese Application JP 64-033315 (B3).

(Continued)

*Primary Examiner* — Teresa M Ekiert
(74) *Attorney, Agent, or Firm* — Reinhart Boerner Van Deuren P.C.

(57) ABSTRACT

The aim of the invention is to provide a method for controlling the flow of material when deep-drawing a workpiece, which better utilizes the drawing capacity of a workpiece and produces a better shape accuracy, particularly of the bottom of the drawn part. The aim is achieved by a method in which the deep-drawing process is performed incrementally and in which at least one bead is incorporated into the flange region of the workpiece prior to each increment of the deep-drawing process. Due to this, the shape accuracy of the bottom can be improved and material accumulations in the flange zone can be prevented.

5 Claims, 4 Drawing Sheets

(56) References Cited

U.S. PATENT DOCUMENTS

| | | | | |
|---|---|---|---|---|
| 5,263,887 | A * | 11/1993 | Cagna et al. | 72/348 |
| 2005/0217344 | A1 | 10/2005 | Losch | |
| 2012/0234070 | A1 * | 9/2012 | Golovashchenko | 72/348 |

FOREIGN PATENT DOCUMENTS

| | | | |
|---|---|---|---|
| DE | 103 34 483 | | 3/2005 |
| DE | 102006003268 | A1 * | 8/2007 |
| EP | 1 526 931 | | 5/2005 |
| JP | 59 206120 | | 11/1984 |
| JP | 01 027726 | | 1/1989 |
| JP | 64 033315 | | 3/1989 |
| JP | 03066423 | A * | 3/1991 |
| JP | 04 083419 | | 7/1992 |
| JP | 2005 095925 | | 4/2005 |

OTHER PUBLICATIONS

International Search Report for International Application No. PCT/EP2009/053835.

* cited by examiner

METHOD FOR CONTROLLING THE FLOW OF MATERIAL WHEN DEEP-DRAWING A WORKPIECE, AND DEEP-DRAWING DEVICE

CROSS-REFERENCE TO RELATED APPLICATIONS

This application is a National Phase Application of International Patent Application No. PCT/EP2009/053835, filed on Mar. 31, 2009, which claims the benefit and priority to German Patent Application No. DE 10 2008 017 728.8-14 filed on Apr. 7, 2008, which is owned by the assignee of the instant application. The disclosure of each of these applications is incorporated herein by reference in its entirety.

FIELD OF THE INVENTION

The invention relates to a method for controlling the flow of material when deep-drawing a workpiece. The invention furthermore relates to a deep-drawing device having a deep-drawing die, which has a guiding section and a forming section, having a blank holder, which supports the positioning of the workpiece on the guiding section during the deep-drawing process, and having a deep-drawing punch, which exerts the force required for deep-drawing.

BACKGROUND

The problem with known methods of controlling the flow of material when deep-drawing a workpiece is that an accumulation of material can form in the flange regions of the workpiece during the deep-drawing process. If so, this leads to the flow of material out of the flange region of the workpiece being reduced or even stopped, so that the material from the regions already deep-drawn, for example the border or the base, thins out during continued deep-drawing, and consequently the risk of a crack forming in these regions presents itself. This is particularly the case if the draw depth is very great or if the workpiece is to be deep-drawn into a drawn part with more strongly bent regions, such as corners for example.

On the other hand, the accuracy of the shape of the base can be impaired by constriction of the base region of the drawn part from the border which occurs during the deep-drawing process. This is because when the base structures are formed in this case there are hardly any regions of pre-stretched material. This can then have a particularly adverse effect if the base surface is distinctly smaller than the border surface.

In order to prevent cracks, workpieces can be used, the diameters of which do not exceed the maximum diameter which is predetermined by the respective maximum drawing ratio related to a swift cup test. However, the deep-drawing method then can only be used for producing drawn parts in specific size ranges. Moreover, the flange regions of the workpiece are comparatively narrow, so that increased care has to be taken during the deep-drawing process. In order to prevent breaks the deep-drawing process can also be carried out in several steps during which the cross-section of the deep-drawing punch is gradually reduced. In this way, the condition predetermined by the maximum drawing ratio can be adhered to longer even when using workpieces with large diameters. However, the tool complexity is increased by this procedure. Furthermore, the cycle time during manufacture is lengthened, whereby the efficiency of the method is reduced. Although facilitating the continued flow of material from the flange region into the deep-drawn regions by reducing the friction of the workpiece, which fundamentally inhibits the flow process, against the deep-drawing die and/or blank holder by using lubricants can assist in carrying out the process correctly, it cannot fully guarantee this, yet. Moreover, additional cleaning procedures are required for the drawn part and the deep-drawing tools when using lubricants. In the flange region of the workpiece, the direction of flow of the material during the deep-drawing process can be slowed down over a particular section by correspondingly arranged braking beads. As a result, the workpiece material can already be ironed before the actual deep-drawing process. However, only the evenness of ironing the material is achieved by this procedure. The enlargement of the entry radius of the workpiece from the guiding section into the forming section of the deep-drawing die is also not given. This can lead to unwanted wrinkle formation on the drawn part.

According to patent specification EP 1 526 931 B1, the material flow is controlled when deep-drawing sheet metal by stamping a Z-shaped blocking step into the edge of the sheet metal, which inhibits the material flow. The blocking step is reduced again in the course of the deep-drawing process, so that the flow of material from the flange region into the die is facilitated. However, an additional deflection of the material and correspondingly elaborate tools, which have to exert high additional forces, are required for this procedure. Moreover, friction is increased by the deflection.

SUMMARY OF THE INVENTION

In general, an aspect of the invention is, therefore, to specify a method and a device which can better exploit the drawing capacity of a workpiece and obtain a higher shape accuracy, particularly at the base of the drawn part.

According to a first teaching of the present invention, the aspect is achieved by a method for controlling the flow of material when deep-drawing a workpiece, in which the deep-drawing process is performed incrementally, and in which at least one bead is incorporated into the flange region of the workpiece prior to each increment of the deep-drawing process.

The shape accuracy of the drawn part can be improved by this procedure. This is because initially the base regions can be pre-stretched by incorporating the bead, which promotes interaction between the deep-drawing punch and the base region occurring in the course of the deep-drawing process increment which follows the incorporation of the bead. Moreover, more material can continue flowing from the flange region of the workpiece into the border through the conveyance to the border. As a result, the risk of a material break, for example in the region of the border or the base, which in particular can be caused by an accumulation of material, is reduced. Therefore, it is possible to obtain a draw depth with predetermined workpieces which exceeds the draw depth predetermined by the known maximum drawing ratio in particular up to a factor of 2.5.

In a preferred embodiment of the method, the bead is only incorporated into the region of corners of the work piece which corners are to be formed. In this way, the method according to the invention can be implemented more efficiently. This is because basically the risk of an accumulation of material only arises more strongly in mores strongly bent regions, such as for example corners. By contrast, in regions of a drawn part which to a large extent run linearly, for example on the long side of a rectangular box, the flow behaviour of the material can be adequate to achieve a satisfactory deep-drawing result without additionally providing a bead. In this way, in particular the tool and process effort can be reduced.

Furthermore, the bead shape can be partly or fully taken out again by the deep-drawing process increment which follows the incorporation of the bead. In this way, the deep-drawing process increment and the incorporation of the bead can be coordinated in an optimum way. As a result, it is ensured that each material section is subjected at least once to pre-stretching caused by the incorporation of the bead.

In a further preferred embodiment of the method, the bead is incorporated with rounded contours. In this way, the method according to the invention can be made suitable for application to workpieces made of sensitive materials. This is because the flow behaviour of the material is modified gently by the rounding of the contours. Material damage through sharp-angled contours is, therefore, avoided.

Preferably, the bead is incorporated with walls running parallel and/or inclined to the deep-drawing direction. As a result, the pre-stretching caused by the incorporation of the bead is advantageously carried out essentially in the deep-drawing direction. As a result, carrying out the process of the deep-drawing process increment which follows the incorporation of the bead can be improved.

According to a further teaching of the present invention, the aspect is also achieved by a deep-drawing device, which is particularly suitable for carrying out a method as described previously, having a deep-drawing die, which has a guiding section and a forming section, having a blank holder, which supports the positioning of the workpiece on the guiding section during the deep-drawing process, and having a deep-drawing punch, which exerts the force required for deep-drawing, wherein a bead punch is provided which can be operated independently and the contour of which is matched to the contour of the guiding section.

The beads can be incorporated into the flange region of the workpiece by means of the bead punch, which can be operated independently, without a drive mechanism coupled to the deep-drawing punch, to the deep-drawing die and/or to the blank holder having to be employed. In this way, the operation of the bead punch can be coordinated very flexibly with the operation of the other components of the device. This in particular makes carrying out the deep-drawing process easier.

In a preferred embodiment of the deep-drawing device, the bead punch has two or more protrusions. In the guiding section of the deep-drawing die, two or more indentations are then arranged opposite to the protrusions, into which indentations the protrusions can be inserted by operating the bead punch. In this way, by simple means more than one bead can be incorporated into the material in the flange region of the workpiece.

Reference is made to the embodiments for the method according to the invention with regard to further advantages of the device according to the invention.

BRIEF DESCRIPTION OF THE DRAWINGS

There are now numerous possibilities for developing and enhancing the method according to the invention and the device according to the invention. The invention will be explained in more detail below with the aid of an exemplary embodiment illustrated in a drawing. In the drawing.

DESCRIPTION

Figure 1B:
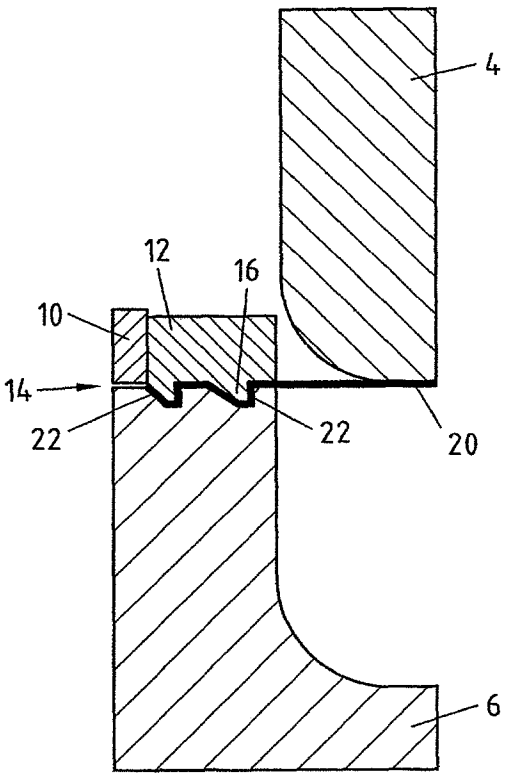
FIGS. 1*a-g* show an exemplary embodiment of the method according to the invention on a schematically depicted device according to the invention in a cross-sectional view.
Figure 1A:
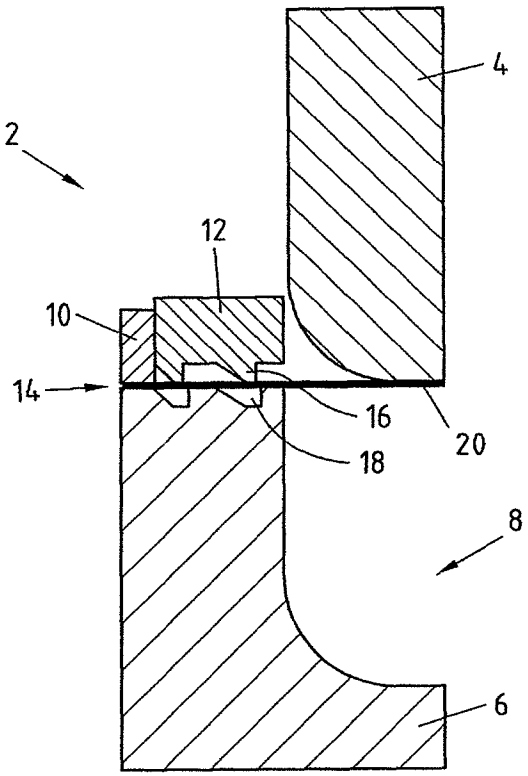

FIG. 1*a* shows a section of a deep-drawing device 2 according to the present invention in a schematic cross-sectional view. The deep-drawing device 2 comprises a deep-drawing punch 4, a deep-drawing die 6, the forming section 8 of which is matched to the deep-drawing punch 4, a blank holder 10 and a bead punch 12 which can be operated independently. The bead punch 12 has two protrusions 16, on its side facing the guiding section 14 of the deep-drawing die 6, which can be inserted into two indentations 18 arranged on the guiding section 14. In this example, both indentations 18 and both protrusions 16 respectively have the same contour. However, the contours in the case of a plurality of indentations 18 and protrusions 16 can also be formed differently among each other, if this is appropriate. It is, of course, also possible to provide just one single indentation 18, to which the bead stamp 12 is then correspondingly matched.

The only blank holder 10 is, in this example, arranged on the side of the bead punch 12 facing away from the deep-drawing punch 4. However, it is also conceivable to provide a plurality of blank holders 10, wherein one is arranged, for example, between deep-drawing stamp 4 and bead punch 12. If a plurality of separate bead punches 12 is present, blank holders 10 can also be arranged between the bead punches 12. The indentations 18 in the guiding section 14 of the deep-drawing die 6 have a wall area, running inclined against the deep-drawing direction, which in this example is arranged on the side of the indentation 18 spaced further apart from the deep-drawing punch 4, whereas the wall areas arranged on the side of the indentation 18 nearer to the deep-drawing punch 4 run essentially parallel to the deep-drawing direction. However, in principle another contour is also conceivable.

In the position shown in FIG. 1*a*, a workpiece 20, for example a steel round blank, is placed in the deep-drawing device 2 between the guiding section 14 of the deep-drawing die 6 on the one side and the bead punch 12 and the blank holder 10 on the other side. The bead punch 12 is at the same time located in a raised position, whereas the blank holder 10 is already in contact with the workpiece 20 under slight pressure. The deep-drawing punch 4 is located in a position above the deep-drawing die 6 such that it is preferably in light contact with the workpiece 20.

FIG. 1*b* now shows, in a first step, how the beads 22 are incorporated into the flange region of the workpiece 20. The bead punch 12 is driven down, independently of the other components 4, 6, 10, onto the guiding section 14. Two beads 22 are incorporated into the workpiece 20 by introducing the protrusions 16 into the indentations 18 arranged on the guiding section 14. As a result, advantageous pre-stretching of the workpiece 20 is produced, since the material flows to the beads 22 on the one hand from the outer part of the flange region and on the other hand from the region of the workpiece 20, arranged between deep-drawing punch 4 and deep-drawing die 6, which is at least partly used to form the base. Furthermore, the material is prepared for the following deep-drawing process increment by incorporating the beads 22. In this simply presented schematic illustration and in what follows, any change in thickness in the workpiece 20 is not depicted for the sake of clarity.

After incorporating the beads 22, the bead punch 12 is again brought into the raised position, so that it is preferably no longer located in the plane of the workpiece 20.

Figure 1D:
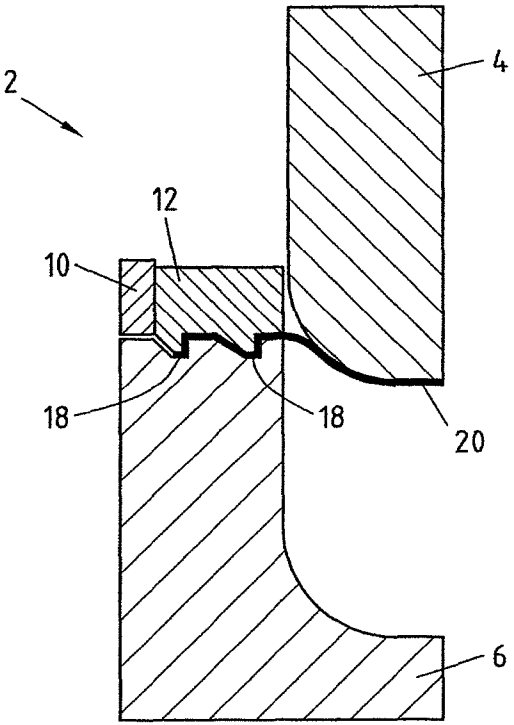
Figure 1C:
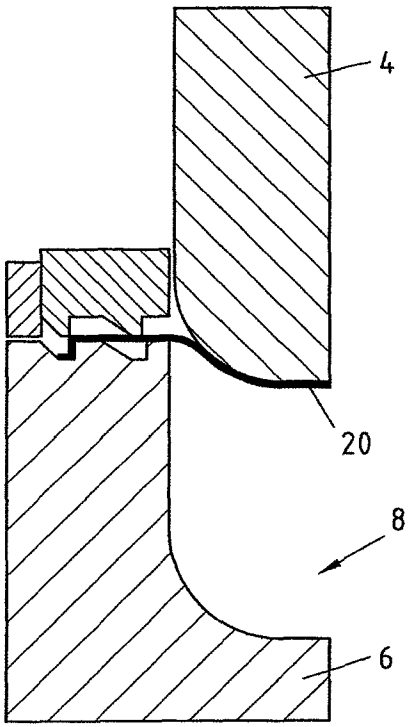

FIG. 1*c* shows the first deep-drawing process increment. The deep-drawing punch 4 is moved by a certain distance in the direction towards the forming section 8 of the deep-drawing die 6. The workpiece 20 is thereby caught by the deep-drawing punch 4 and drawn into the forming section 8 by the corresponding distance. In this example, the distance is calculated precisely such that the material expended for forming the bead 22 nearer to the deep-drawing punch 4 is fully expended for the deep-drawing process increment. As a result, the shape of said bead 22 is to a large extent taken out of the workpiece 20 again. In this way, the material can continue flowing well both in largely linear and in highly curved areas, for example at corners. An accumulation of material in the flange region is that way essentially prevented. After the movement, the deep-drawing punch 4 remains in the position shown in FIG. 1*c*.

FIG. 1*d* shows how the bead punch 12 is operated a further time independently of the other components 4, 6, 10 of the deep-drawing device 2 and how the beads 22 are incorporated into the remaining flange region of the workpiece 20. The material is thereby conveyed to the beads 22 essentially from the outer part of the flange. After the bead punch 12 has been operated it is again brought into the raised position.

Figure 1F:
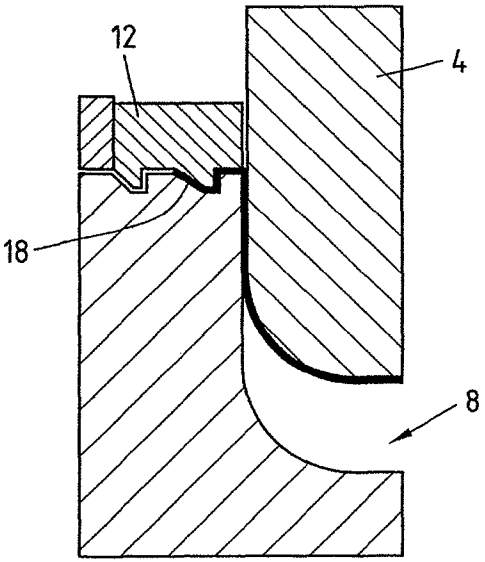
Figure 1E:
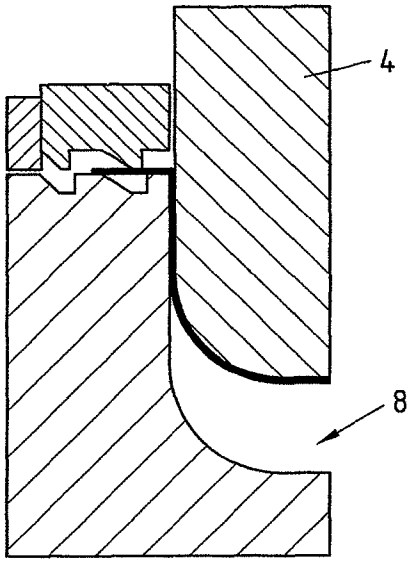

FIG. 1*e* shows the next deep-drawing process increment. The deep-drawing punch 4 is driven further in the direction towards the forming section 8. The shape of the bead 22 nearer to the deep-drawing punch 4 is thereby almost taken out again. The deep-drawing punch 4 remains in the position shown.

FIG. 1*f* shows the next operation of the bead punch 12. The flange region has become so narrow owing to the deep-drawing process that only one bead 22 can be incorporated.

Figure 1G:
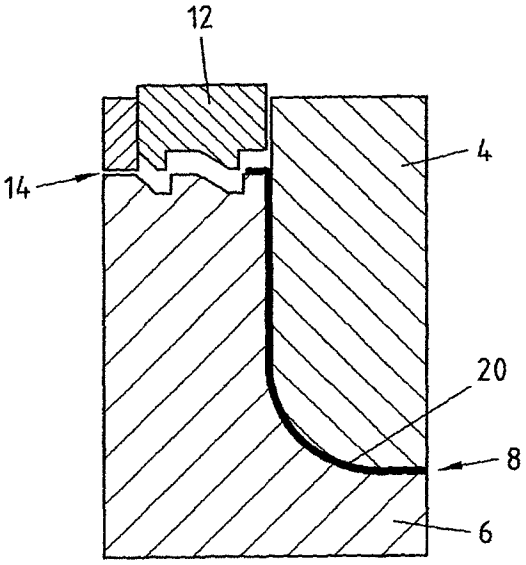

FIG. 1*g* shows the last deep-drawing process increment. The deep-drawing punch 4 in this example is driven all the way down onto the forming section 8 of the deep-drawing die 6. The workpiece 20 is, as a result, almost fully drawn out of the region between guiding section 14 and bead punch 12. The deep-drawing process is thereby completed. The deep-drawing punch 4 can now be raised in order to remove the finished drawn part from the deep-drawing die 6.

The invention claimed is:

1. A method for forming a workpiece, the method comprising:

forming a bead into a flange region of the workpiece;

deep-drawing the workpiece in a first incremental deep drawing step;

forming a subsequent bead into the flange region of the workpiece, wherein the first incremental deep-drawing step is paused while the step of forming the subsequent bead is performed; and deep-drawing the workpiece in a second incremental deep drawing step after the step of forming the subsequent bead is performed.

2. The method of claim 1, wherein the bead and the subsequent bead are only formed into a region of the workpiece in which corners are to be formed.

3. The method claim 1, wherein a shape of the bead and the subsequent bead is partly or fully taken out by the first incremental deep drawing step and the second incremental deep drawing step, respectively.

4. The method according to claim 1, wherein the bead and the subsequent bead are formed with rounded contours.

5. The method according to claim 1, wherein the bead and the subsequent bead are formed with walls running parallel and/or inclined to a deep-drawing direction.

* * * * *